US005871364A

United States Patent [19]

Shinchi et al.

[11] Patent Number: 5,871,364

[45] Date of Patent: Feb. 16, 1999

[54] CONNECTOR WITH PROTECTIVE COVER

[75] Inventors: Akira Shinchi; Noboru Yamaguchi, both of Shizuoka, Japan

[73] Assignee: Yazaki Corporation, Tokyo, Japan

[21] Appl. No.: 698,799

[22] Filed: Aug. 16, 1996

[30] Foreign Application Priority Data

Aug. 29, 1995 [JP] Japan ..... 7-220585

[51] Int. Cl.[6] ..... H01R 13/44

[52] U.S. Cl. ..... 439/144; 439/157

[58] Field of Search ..... 439/136, 138, 439/142, 144, 917, 521, 467, 752, 372, 310, 157, 595, 456, 457, 459, 746, 747, 748, 749

[56] References Cited

U.S. PATENT DOCUMENTS

| | | | |
|---|---|---|---|
| 3,615,986 | 10/1971 | Dickason | 156/105 |
| 4,195,194 | 3/1980 | Kuster et al. | 439/456 |
| 5,238,411 | 8/1993 | Jinno et al. | 439/595 |
| 5,244,400 | 9/1993 | Hatagishi | 439/157 |
| 5,413,500 | 5/1995 | Tanaka | 439/521 |
| 5,518,334 | 5/1996 | Yagi et al. | 439/752 |
| 5,571,023 | 11/1996 | Anthony | 439/142 |

FOREIGN PATENT DOCUMENTS

| | | | |
|---|---|---|---|
| 7-176342 | 7/1995 | Japan | H01R 13/42 |
| 8-83631 | 3/1996 | Japan | H01R 4/24 |

*Primary Examiner*—Neil Abrams
*Assistant Examiner*—Barry M. L. Standig
*Attorney, Agent, or Firm*—Sughrue, Mion, Zinn, Macpeak & Seas, PLLC

[57] ABSTRACT

A connector with a protective cover in which the protective cover covers the connector and an exposed, fixed terminal, thereby enhancing safety, and a connector fitting operation can be effected easily without increasing the time and labor required for an assembling operation. The connector with the protective cover includes a connector portion receiving a connection terminal connected to one end of a power source-side wire, and a cover portion integrally connected to a front end of a connector housing of the connector portion through a hinge. When the cover portion is fitted on and connected to the connector portion, the whole of the connector housing and an exposed, fixed terminal can be positively protected. At the same time, the connection terminal is retained by a projection formed on a reverse surface of the cover portion.

15 Claims, 10 Drawing Sheets

CONNECTOR WITH PROTECTIVE COVER

BACKGROUND OF THE INVENTION

1. Field of the Invention

This invention relates to a connector with a protective cover, and more particularly to a connector with a protective cover in which the protective cover covers a connector housing and an exposed, fixed terminal, and also retains a connection terminal, provided in the connector housing, in a double manner.

2. Background

Usually, a rear window defogger (rear electric heating wire) is mounted on a rear window glass panel of an automobile so as to remove moisture and ice from the rear window glass panel to thereby secure a clear view. This rear window defogger includes an electric resistance wire printed in a meandering manner on the inner side of the rear window glass panel facing a compartment of the automobile. A male terminal, fixedly secured on the rear window glass panel, is connected to one end of the rear window defogger. A connector, having a female terminal connected to one end of a power source-side wire, is fitted on this exposed, fixed terminal, thereby electrically connecting the female terminal to the fixed male terminal.

More specifically, in electric wiring 1 of an automobile shown in FIG. 9, electric power is supplied to a rear window defogger 2 via a thick, power source-wire W extending from a battery 3 through a fuse box 4 to the vicinity of one end of the rear window defogger 2. A switch 5, mounted on an instrument panel, is turned on and off to activate and deactivate the rear window defogger 2. As shown in FIG. 10, a fixed terminal 8 is fixedly secured to a rear window glass panel 6, and is connected to the end of the rear window defogger 2, and the power source-side wire W is connected to the fixed terminal 8 through a connector 7 having a female terminal mounted therein.

As shown in FIG. 11, the connector 7 for fitting on the fixed terminal 8 fixedly mounted on the rear window glass panel has a terminal fitting opening 7*b* formed in its front end through which opening 7*b* the fixed terminal 8 is fitted in the connector 7. A terminal insertion opening (not shown) for inserting the female terminal, connected to the end of the power source-side wire W, into the connector 7, is formed in a rear end surface thereof. A holder 9 for retaining the female terminal in a double manner is hingedly connected to an outer surface of a connector housing 7*a*

For fitting the connector 7 on the fixed terminal 8, the female terminal is first inserted into the connector housing 7*a*, and is retained by a retaining lance (not shown) formed in the connector housing 7*a*. Then, the holder 9 is pivotally moved to be fitted into the connector housing 7*a*, thereby retaining the female terminal in a double manner. Then, the fixed terminal 8 is fitted in the terminal fitting opening 7*b*, so that the fixed terminal 8 and the female terminal are electrically connected together within the connector housing 7*a*

However, the fixed terminal (male terminal) 8 is partly exposed even after the fitting of the connector, and therefore needs to be electrically insulated. And besides, there is a chance that when the operator is to fit and disengage the connector 7, the fingers and so on are injured by an exposed edge of the male terminal.

If a cover is merely attached to the connector housing 7*a*, this increases the time and labor required for the assembling operation, and the connector of a relatively small size must be fitted, and the assembling efficiency is lowered.

SUMMARY OF THE INVENTION

It is an object of this invention to provide a connector with a protective cover in which the protective cover covers the connector and an exposed, fixed terminal, thereby enhancing safety, and a connector fitting operation can be effected easily without increasing the time and labor required for an assembling operation.

The above object of the invention has been achieved by a connector with a protective terminal wherein the connector, having a connection terminal mounted in a connector housing, is fitted on an exposed, fixed terminal, thereby electrically connecting the connection terminal to the fixed terminal; in which the protective cover is fitted on and connected to the connector housing to protect the whole of the connector housing and the exposed, fixed terminal and also to retain the connection terminal.

A projection for retaining the connection terminal is formed on a reverse surface of the protective cover.

The protective cover is either hingedly connected to the connector housing or separate from the connector housing.

With this construction of the connector with the protective cover, the whole of the connector housing and the exposed, fixed terminal are completely covered with the protective cover, thereby achieving safety. Simultaneously with the fitting of the protective cover on the connector housing, the connection terminal, received in the connector, is retained by the projection formed on the reverse surface of the protective cover, and therefore the time and labor, required for the assembling operation, is not increased by the provision of the protective cover.

The protective cover has sliding grooves for connector-fitting purposes, and a rotation shaft for pivotal movement purposes, and the connector housing has guide pins for fitting purposes formed on an outer surface thereof.

The fixed terminal has an engagement portion in which the rotation shaft is engageable.

With this construction of the connector with the protective cover, the connector housing is provisionally fitted on the fixed terminal, and then the rotation shaft of the protective cover is fitted in the engagement portion of the fixed terminal, and also the guide pins of the connector housing are engaged respectively in inlet portions of the sliding grooves. Then, when the protective cover is pivotally moved about the rotation shaft, the guide pins are moved deeper into the respective sliding grooves.

As a result, the connector housing is moved to be completely fitted on the fixed terminal, and also is fitted in the protective cover, and in the completely-fitted condition, the connection terminal in the connector housing is retained by the projection on the reverse surface of the protective cover. Therefore, the fitting of the connector housing can be effected safely and easily.

DETAILED DESCRIPTION OF THE PREFERRED EMBODIMENTS

Figure 1:
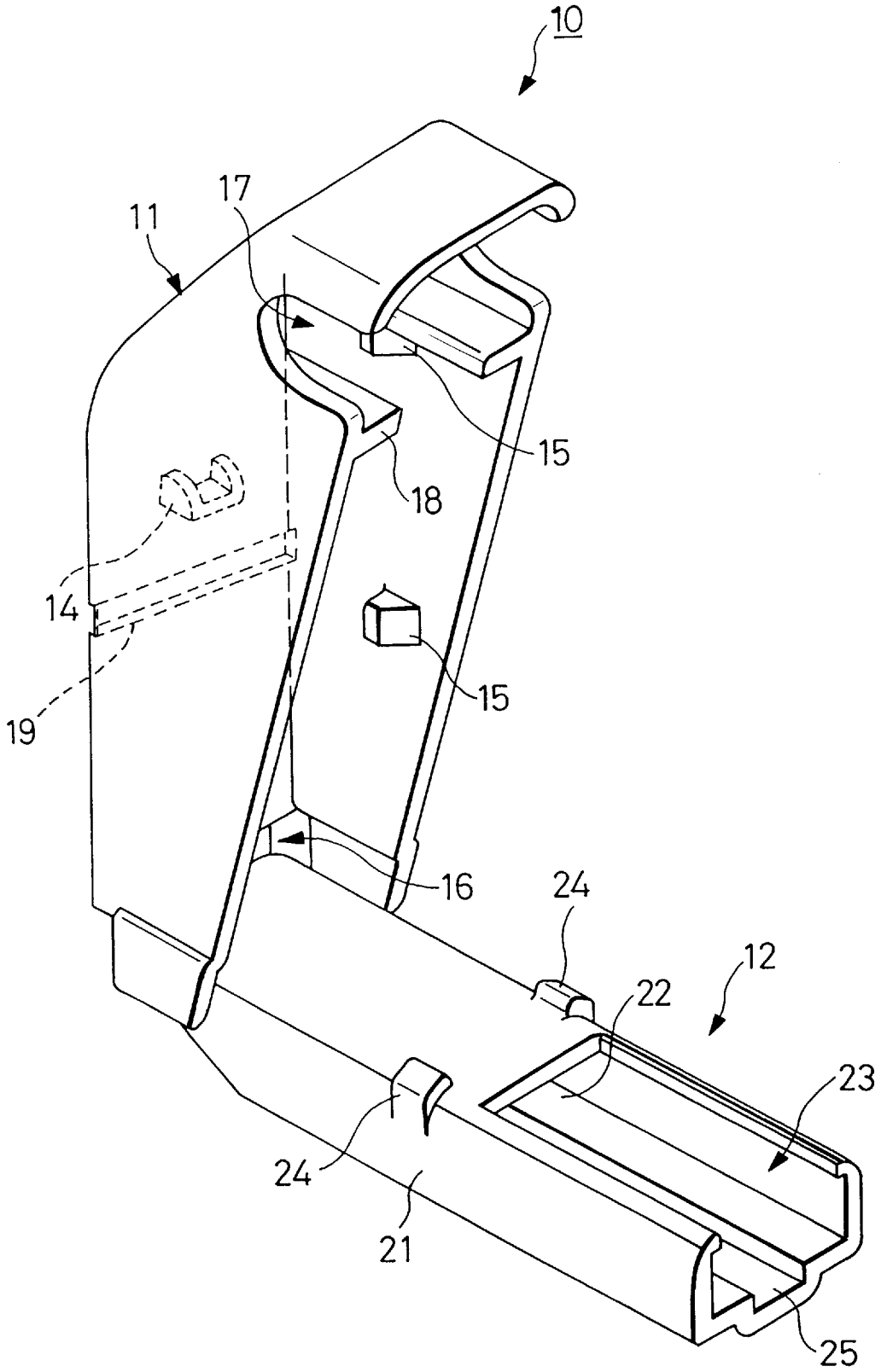
FIG. 1 is a perspective view of a first embodiment of a connector of the invention with a protective cover.
Figure 3:
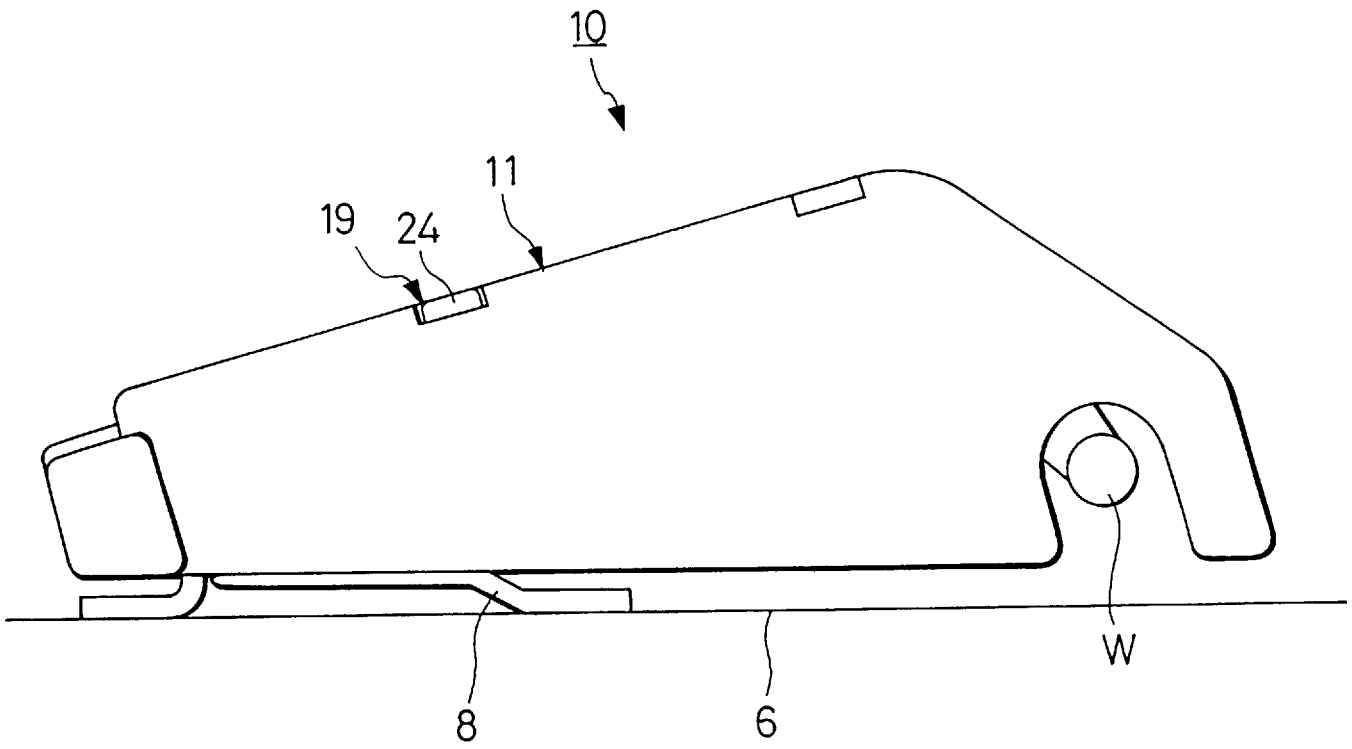
FIG. 3 is a side-elevational view showing a fitted condition of the protective cover.
Figure 4:
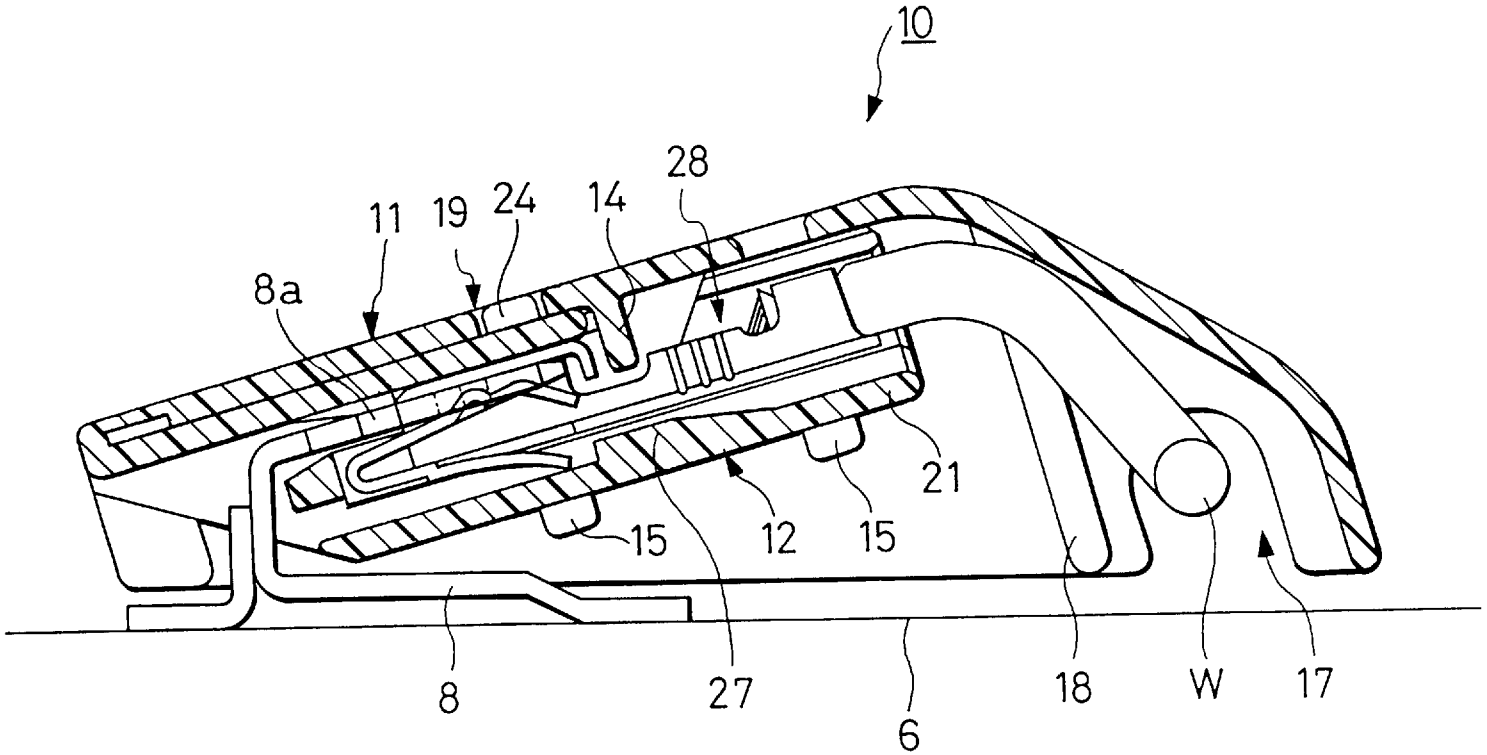
FIG. 4 is a cross-sectional view of the connector in the condition of FIG. 3.

A first embodiment of a connector of the invention with a protective cover will now be described in detail with reference to FIGS. 1 to 4. FIG. 1 is a perspective view showing the construction of the connector of the invention with the protective cover, FIG. 2 is a cross-sectional view of the connector in the condition of FIG. 1, FIG. 3 is a side-elevational view showing a fitted condition of the protective cover, and FIG. 4 is a cross-sectional view of the connector in the condition of FIG. 3.

Figure 2:
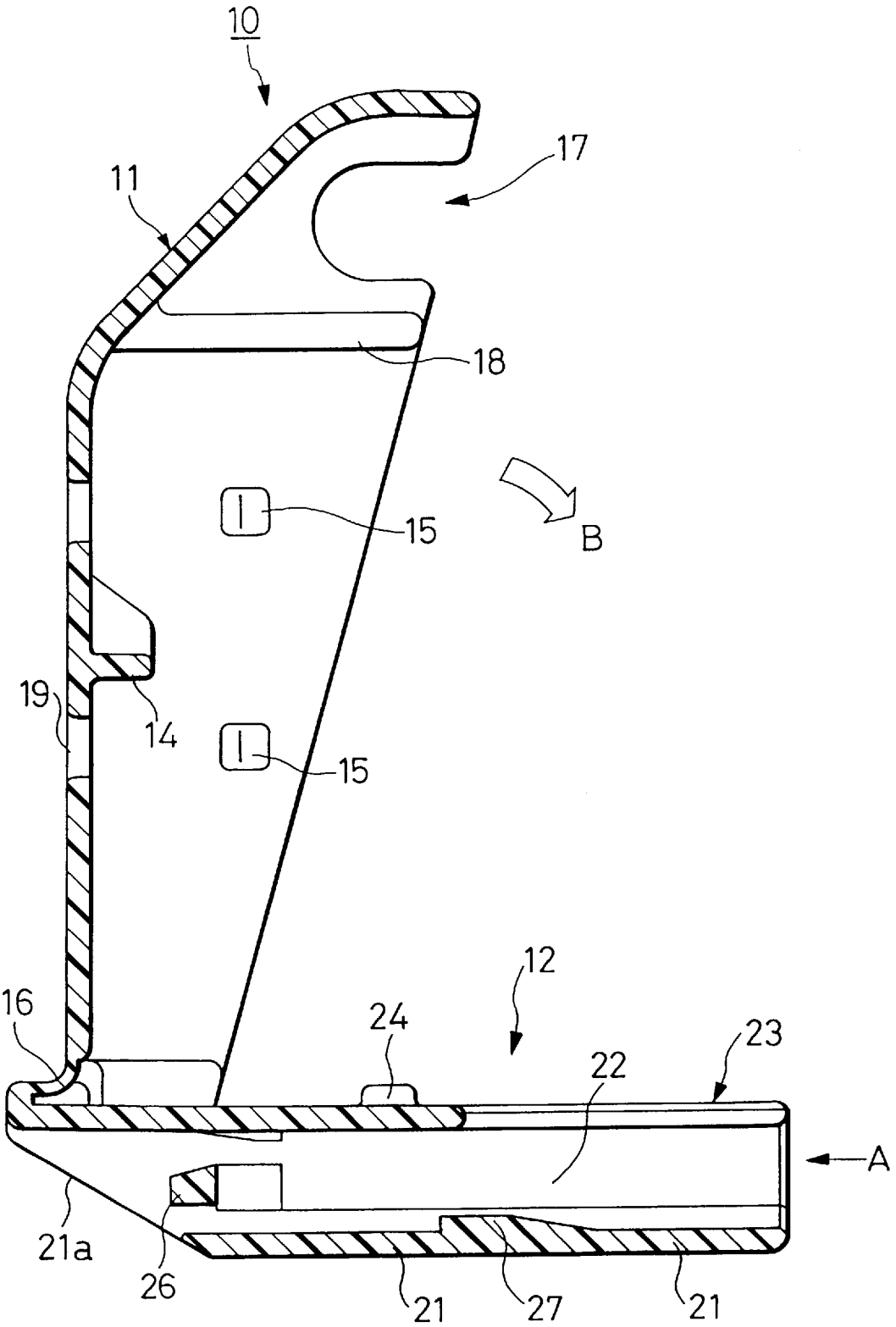
FIG. 2 is a cross-sectional view of the connector in the condition of FIG. 1.

As shown in FIGS. 1 and 2, the connector 10 of this embodiment with the protective cover includes a connector portion 12 for receiving a female terminal 28 (see FIG. 4) connected to one end of a power source-side wire, and a cover portion 11 integrally connected to a front end of a connector housing 21 of the connector portion 12 through a hinge 16.

A projection 14 for retaining the female terminal, received in the connector portion 12, is formed on a reverse or inner surface of the cover portion 11. A plurality of fitting projections 15 for retaining the fitted connector portion 12 are formed on the inner surface of the cover portion 11, and a pair of partition walls 18 for preventing rearward movement of the connector portion 12 relative to the cover portion 11 are formed on the inner surface of the cover portion 11. An engagement hole 19 for receiving engagement projections 24 (more fully described later) formed on the connector portion 12 is formed through a top wall of the cover portion 12. Wire support holes 17 for limiting the direction of the power source-side wire W are formed respectively through opposite side walls of the cover portion 11 at the rear portion of the cover portion 11.

The connector portion 12 has a terminal receiving chamber 22 therein for receiving the female terminal, and a guide groove 25 for guiding the insertion of the female terminal is formed in a bottom surface of the terminal receiving chamber 22, and a retaining projection 27 (see FIG. 2) for retaining the female terminal is formed on the bottom surface of the terminal receiving chamber 22. A stopper piece portion 26 for positioning the female terminal is formed at a front end of the terminal receiving chamber 22. The engagement projections 24 for engaging into the engagement hole 19 in the cover portion 11 are formed on the connector housing 21, and an opening 23 for receiving the projection 14 on the reverse surface of the cover portion 11 is formed in the rear portion of the connector housing 21.

The procedure of fitting the connector 10 on a fixed terminal 8 will now be described. First, the female terminal is inserted into the terminal receiving chamber 22 through the opening 23 in the connector portion 12 in a direction of arrow A (FIG. 2), and the female terminal is abutted at its front end against the stopper piece portion 26, and is retained in a predetermined position in the terminal receiving chamber 22 by the retaining projection 27.

Then, the connector portion 12 is fitted on a connection portion 8*a* (see FIG. 4) of the fixed terminal 8 (which is fixedly secured to a rear window glass panel 6) through a front end 21*a* of the connector portion 12, and then the cover portion 11 is pivotally moved about the hinge 16 in a direction (of arrow B) toward the connector portion 12.

As a result, the fitting projections 15 slide past the side walls of the connector housing 21, and are retainingly engaged with the lower side of the connector housing, and also the engagement projections 24 on the connector housing 21 are engaged in the engagement hole 19 in the cover portion 11, so that the cover portion 11 is fitted on and connected to the connector portion 12. At this time, the projection 14 on the reverse surface of the cover portion 11 is introduced into the connector housing 21 through the opening 23, and retains, together with the retaining projection 27 in the terminal receiving chamber 22, the female terminal 28 in a double manner. Finally, the power source-side wire W is passed through one of the wire support holes 17 to be supported in a desired direction.

Figure 5:
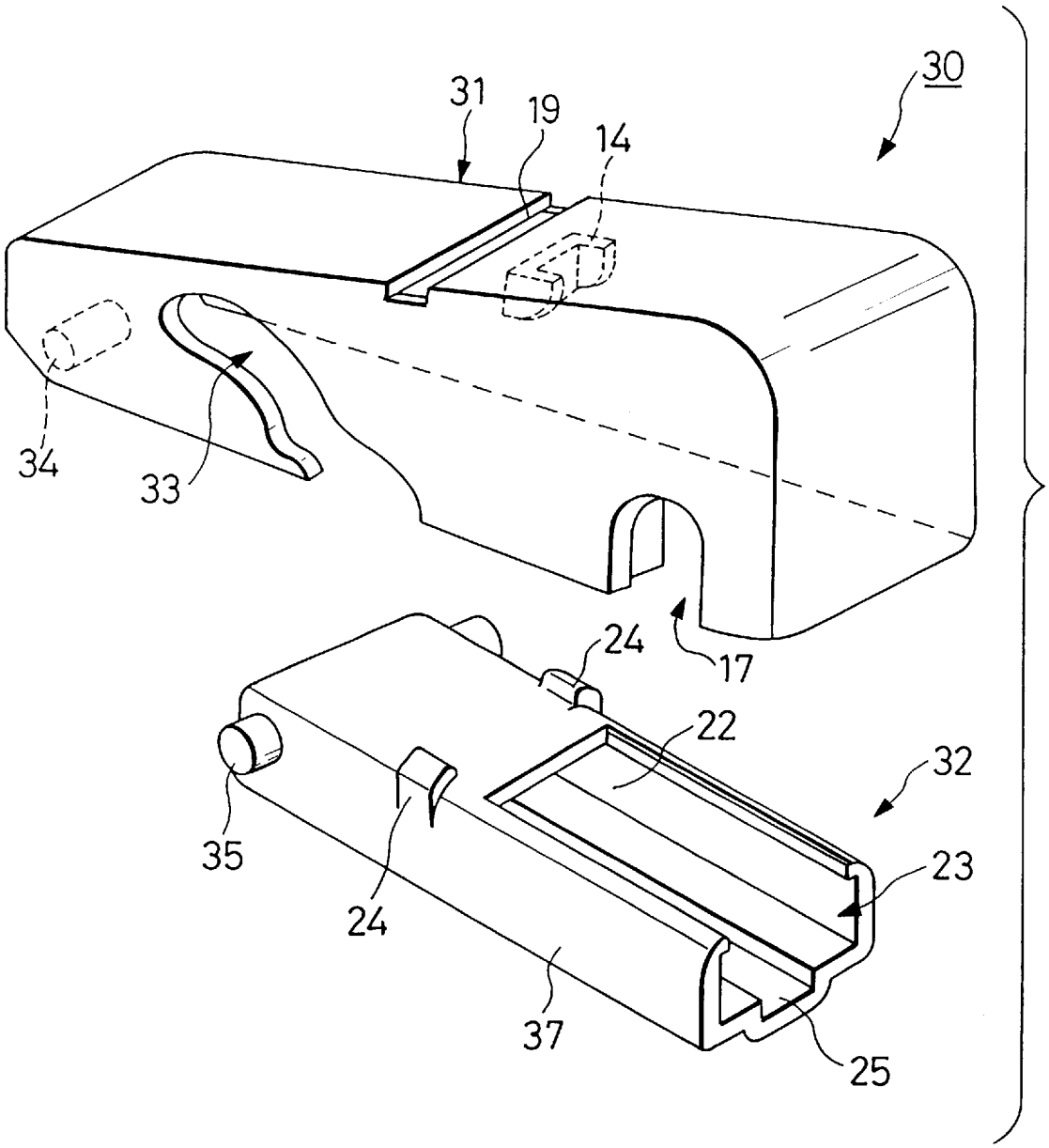
FIG. 5 is a perspective view of a second embodiment of a connector of the invention with a protective cover.
Figure 6:
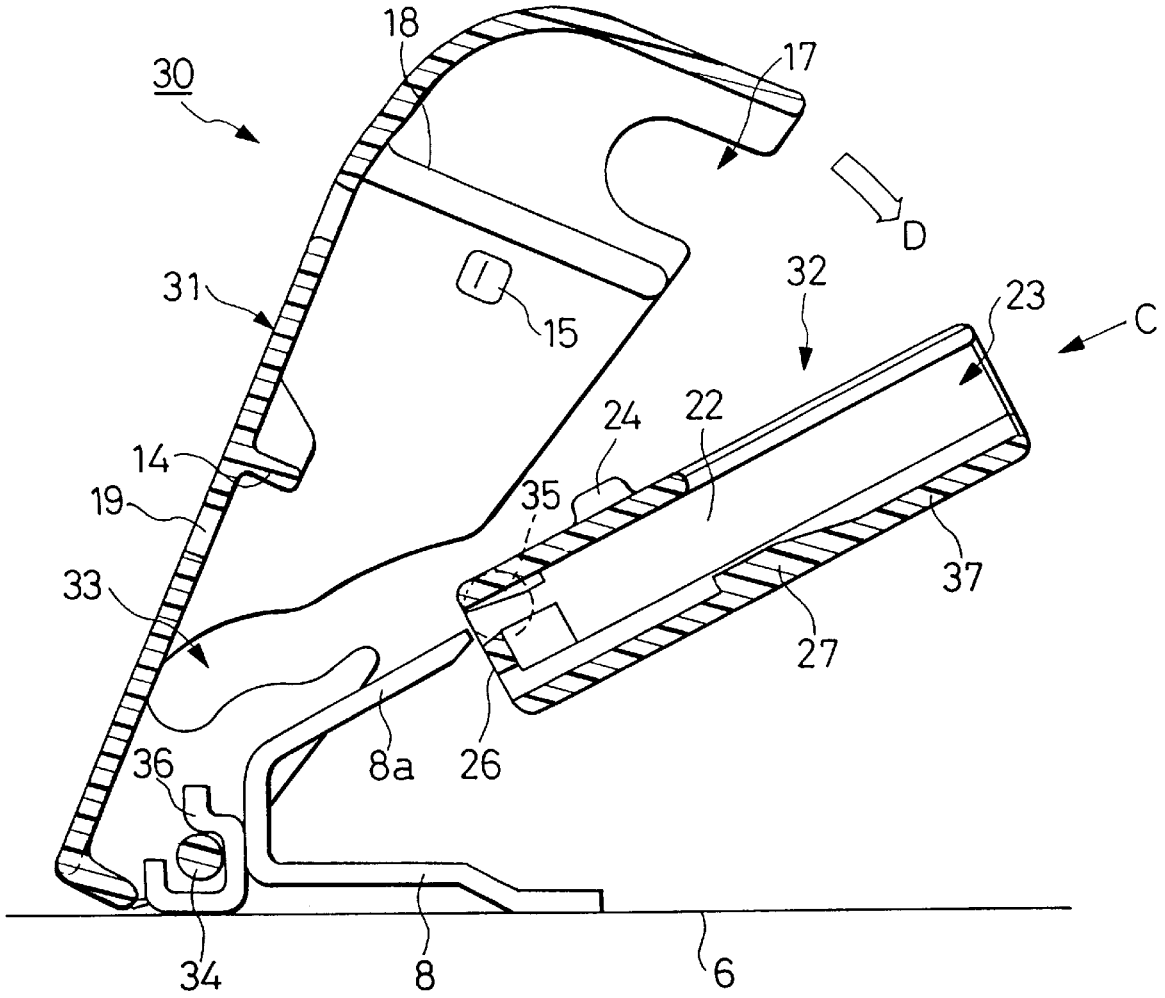
FIG. 6 is a cross-sectional view of the connector in the condition of FIG. 5.
Figure 7:
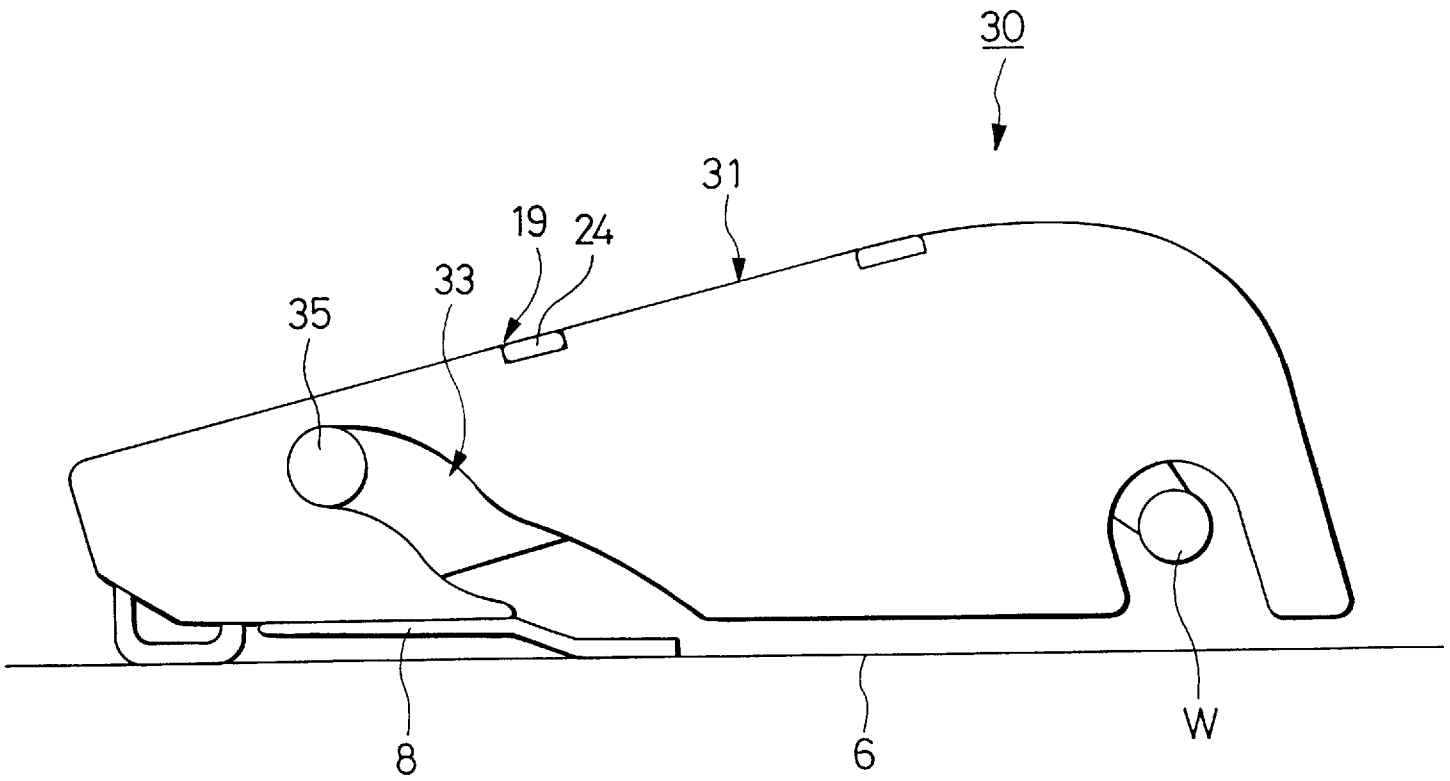
FIG. 7 is a side-elevational view showing a fitted condition of the protective cover of FIG. 5.
Figure 8:
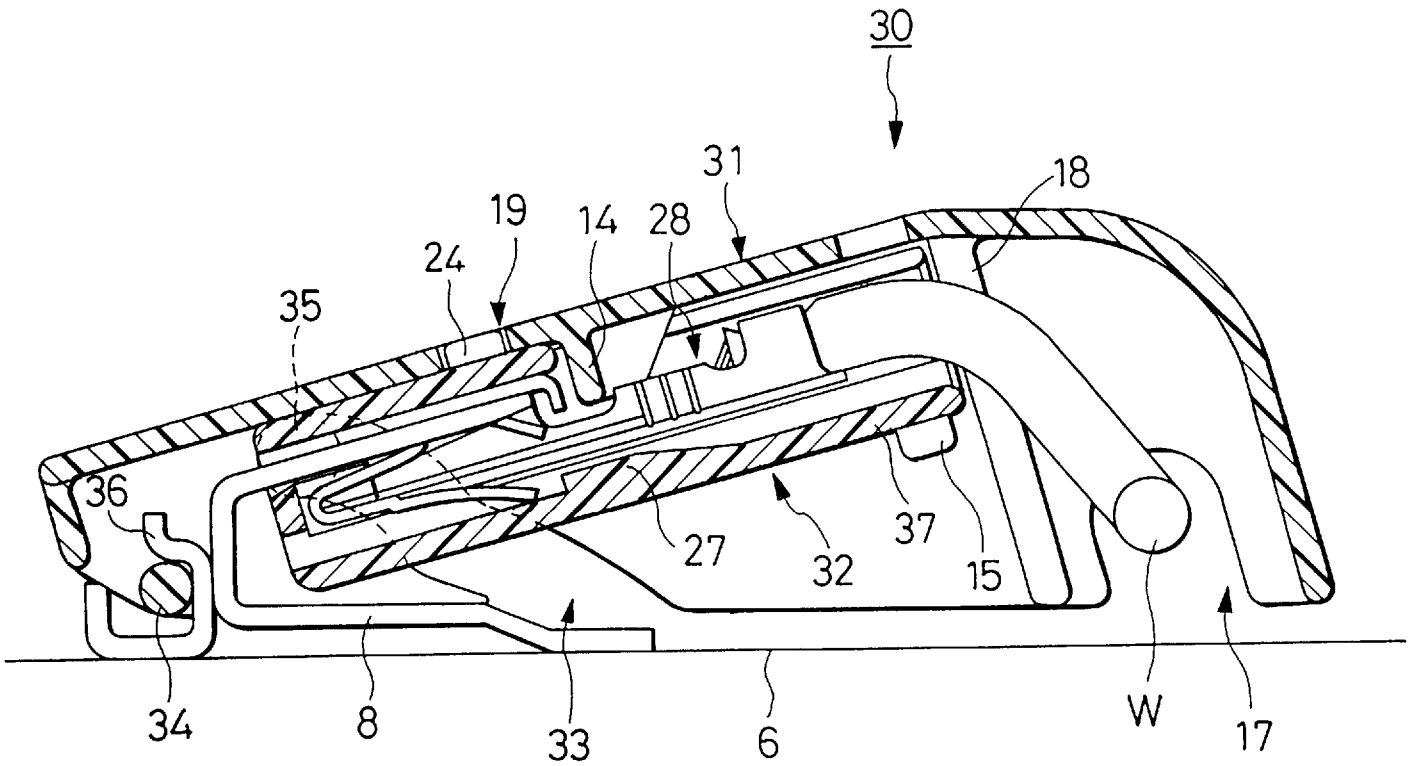
FIG. 8 is a cross-sectional view of the connector in the condition of FIG. 7.
Figure 9:
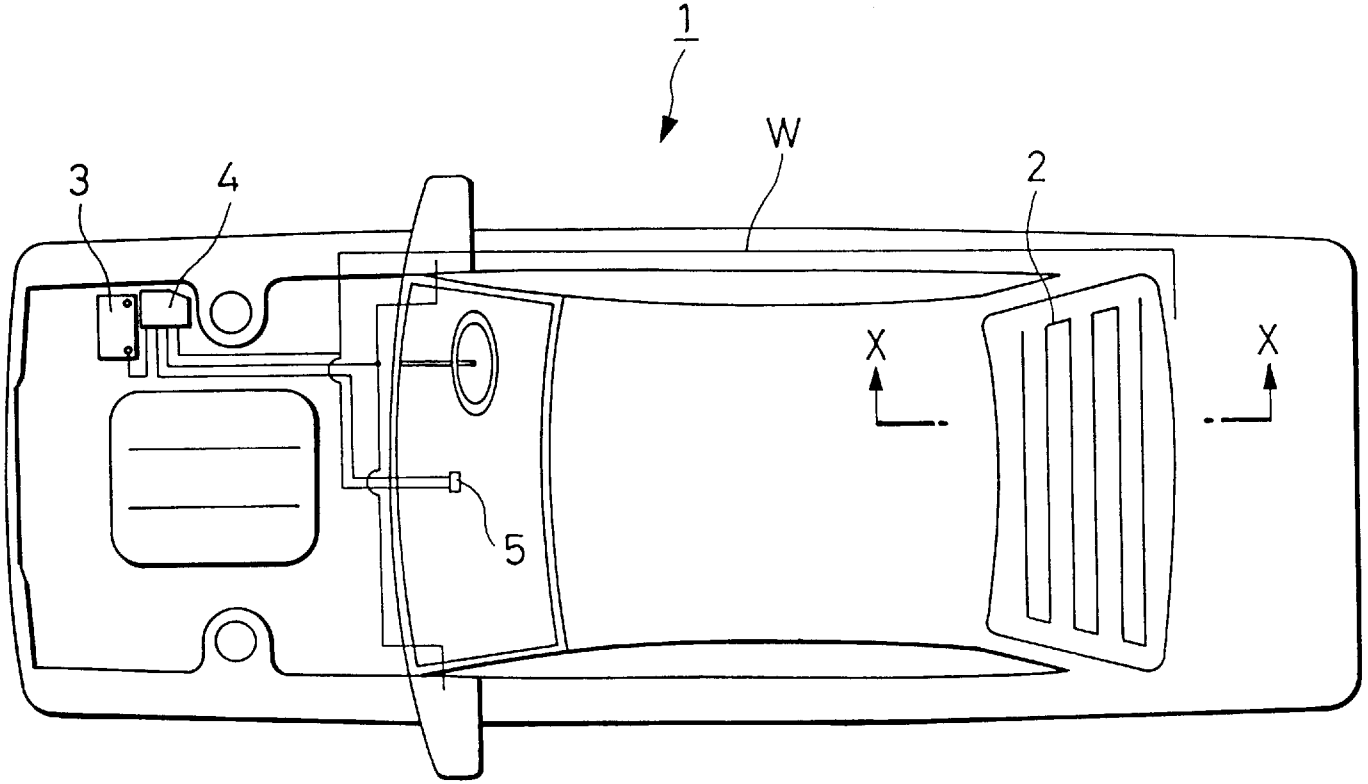
FIG. 9 PRIOR ART
FIG. 9 is a schematic plan view showing prior art electric wiring to a rear window defogger in an automobile.
Figure 10:
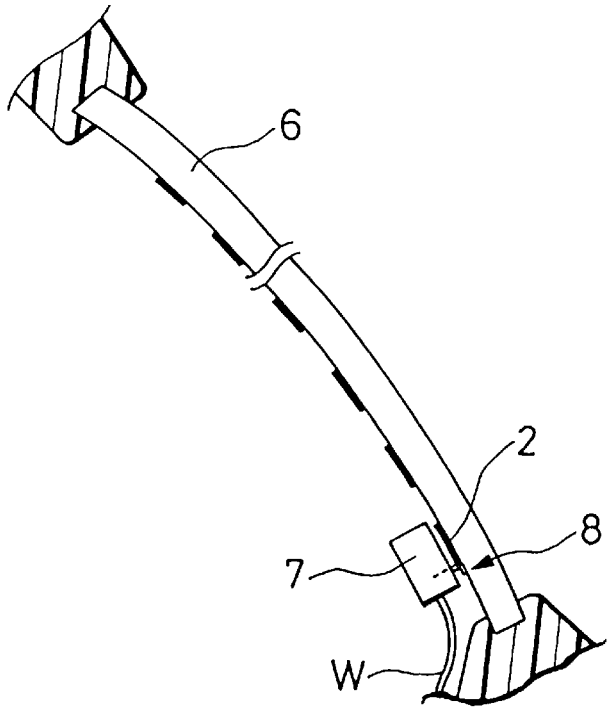
FIG. 10 PRIOR ART
FIG. 10 is a cross-sectional view taken along the line X—X of FIG. 9.
Figure 11:
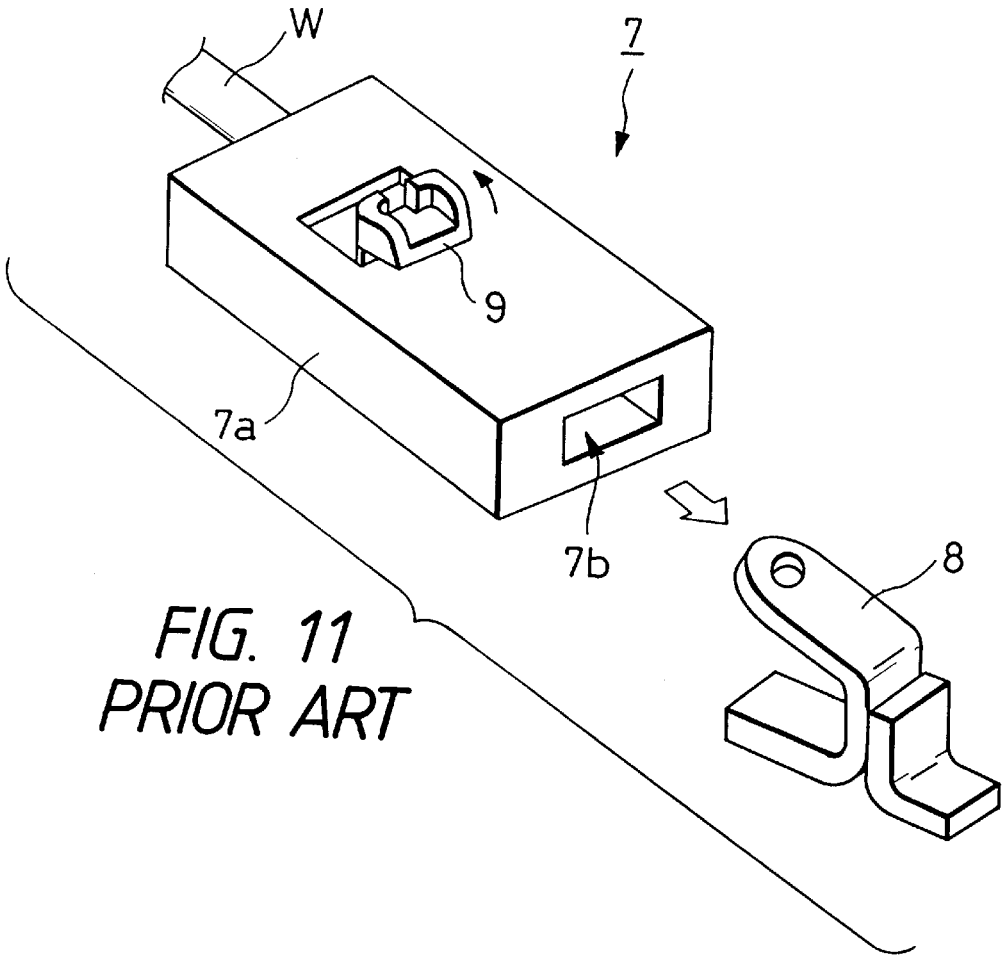
FIG. 11 PRIOR ART
FIG. 11 is an enlarged, perspective view showing a conventional fixed terminal and a conventional connector.

Next, a second embodiment of a connector of the invention with a protective cover will now be described in detail with reference to FIGS. 5 to 8. FIG. 5 is a perspective view showing the construction of the connector of the invention with the protective cover, FIG. 6 is a cross-sectional view of the connector in the condition of FIG. 5, FIG. 7 is a side-elevational view showing a fitted condition of the protective cover, and FIG. 8 is a cross-sectional view of the connector in the condition of FIG. 7. Those portions of this embodiment identical respectively to those of the connector of the first embodiment will be designated by identical reference numerals, respectively, and explanation thereof will be omitted.

As shown in FIGS. 5 and 6, the connector 30 of this embodiment with the protective cover includes a connector portion 32 for receiving a female terminal 28 (see FIG. 8) connected to one end of a power-source-side wire W, and a cover portion 31 separate from the connector portion 32.

The connector of this embodiment differs from the connector 10 of the first embodiment in that a rotation shaft 34 for pivotal movement purposes is provided on the inner side of the cover portion 31, and that a pair of sliding grooves 33 for connector-fitting purposes are formed in a slanting manner through opposite side walls of the cover portion 31, respectively.

A pair of guide pins 35 for being received respectively in the sliding grooves 33 in the cover portion 31 are formed on opposite side walls of a connector housing 37, respectively. A fixed terminal 8 has an engagement portion 36 for receiving the rotation shaft 34 of the cover portion 31.

The procedure of fitting the connector 30 on the fixed terminal 8 will now be described. First, the female terminal is inserted into a terminal receiving chamber 22 through an opening 23 in the connector portion 32 in a direction of arrow C (FIG. 6), and the female terminal is abutted at its front end against a stopper piece portion 26, and is retained in a predetermined position in the terminal receiving chamber 22 by a retaining projection 27. Then, the connector portion 32 is provisionally fitted on a connection portion 8*a* (see FIG. 4) of the fixed terminal 8 (which is fixedly secured to a rear window glass panel 6) through a front end of the connector portion 32, and then the rotation shaft 34 of the cover portion 31 is fitted in the engagement portion 36 of the fixed terminal 8, and the guide pins 35 of the connector portion 32 are engaged in inlet portions of the sliding grooves 33, respectively. Then, the cover portion 31 is pivotally moved in a direction (of arrow D) toward the connector portion 32.

As shown in FIGS. 7 and 8, when the cover portion 31 is pivotally moved about the rotation shaft 34, the guide pins 35 moves deeper into the sliding grooves 33, respectively. More specifically, the connector portion 32 is moved to be completely fitted on the fixed terminal 8 on the rear window glass panel 6, and also is fitted in the cover portion 31. In the completely-fitted condition of the connector portion 32, the female terminal 28 in the connector portion 32 is retained in a double manner by a projection 14 on the inner surface of the cover portion 31 and the retaining projection 27 in the terminal receiving chamber. At this time, fitting projections 15 on the inner side of the cover portion 31 slide past the side walls of the connector housing 21, and are retainingly engaged with the lower side of the connector housing, so that the cover portion 31 is fitted on the connector portion 32. Finally, the power source-side wire W is passed through one of wire support holes 17 to be supported in a desired direction. With this construction, the fitting of the connector portion 32 can be effected safely and easily.

As described above, in the connector of the invention with the protective cover, there is provided the protective cover which covers the whole of-the connector housing and the exposed, fixed terminal, and also retains the connection terminal in the connector housing.

Therefore, by fitting the protective cover on the connector housing, the whole of the connector housing and the exposed, fixed terminal can be completely covered. Therefore, there can be positively avoided an accident in which the operator and a child are injured by an exposed edge of the fixed terminal, thereby securing safety.

Simultaneously with the fitting of the protective cover, the connection terminal, received in the connector housing, is retained in a double manner, and therefore the provision of the protective cover will not increase the time and labor required for the assembling operation.

The protective cover has the sliding grooves for connector-fitting purposes, and the rotation shaft for pivotal movement purposes, and the connector housing has the guide pins for fitting purposes formed on the outer surface thereof.

Therefore, the connector housing is provisionally fitted on the fixed terminal, and also the guide pins of the connector housing are engaged respectively in the inlet portions of the sliding grooves. Then, when the protective cover is pivotally moved about the rotation shaft toward the connector housing, the guide pins are moved deeper into the respective sliding grooves. As a result, the connector housing is moved to be completely fitted on the fixed terminal, and also is fitted in the protective cover, and therefore the fitting of the connector housing can be effected positively and easily.

What is claimed is:

1. A connector comprising:

a housing including a terminal receiving chamber having a retaining portion;

a first terminal, for mating with a second terminal, accommodated in said terminal receiving chamber, said first terminal being retained with said retaining portion; and a protective cover, for covering said housing and said second terminal mated to said first terminal, connected to said housing via a connecting member to pivotally move about said connecting member, wherein a plurality of fitting projections are formed on an inner surface of side walls of said protective cover, and wherein when said protective cover covers said housing, said fitting projections slide past an outer surface of side walls of said housing, and engage with a lower side of said housing, for retaining said protective cover in a closed position on said housing.

2. The connector of claim 1, wherein said protective cover has a projection formed on a reverse surface thereof for retaining said first terminal.

3. The connector of claim 1, wherein said connecting member includes a hinge portion.

4. The connector of claim 1, wherein said connecting member includes a rotation shaft, and said second terminal has a engagement portion for receiving said rotation shaft.

5. The connector of claim 4, wherein said rotation shaft is formed on an inner side of said protective cover.

6. The connector of claim 1, wherein said protective cover is separate from said housing.

7. A connector, comprising:

a housing including a terminal receiving chamber having a retaining portion;

a first terminal, for mating with a second terminal, accommodated in said terminal receiving chamber, said first terminal being retained with said retaining portion; and a protective cover, for covering said housing and said second terminal mated to said first terminal, connected to said housing via a connecting member to pivotally move about said connecting member, wherein said protective cover has a pair of sliding grooves, and said housing has a pair of guide pins formed on an outer surface thereof to engage with said sliding grooves, respectively.

8. The connector of claim 7, wherein said sliding grooves are formed in a slanting manner through opposite side walls of said protective cover.

9. The connector of claim 1, the connector being a connector for fitting onto a vehicle, wherein said second terminal is fixed to a glass window panel of said vehicle.

10. A connector, comprising:

a housing including a terminal receiving chamber having a retaining portion;

a first terminal, for mating with a second terminal, accommodated in said terminal receiving chamber, said first terminal being retained with said retaining portion; and a protective cover, for covering said housing and said second terminal mated to said first terminal, connected to said housing via a connecting member to pivotally move about said connecting member, wherein engagement projections ar formed on said housing, and an engagement hole, for receiving said engagement projections, is formed through a top wall of said protective cover.

11. The connector of claim 10, wherein when said protective cover covers said housing, said engagement projections are engaged in said engagement hole.

12. The connector of claim 1, wherein said first terminal is a female terminal, and said second terminal is a male terminal.

13. The connector of claim 1, wherein said retaining portion includes a retaining projection formed on a bottom surface of said terminal receiving chamber.

14. A connector, comprising:

a housing including a terminal receiving chamber having a retaining portion;

a first terminal, for mating with a second terminal, accommodated in said terminal receiving chamber, said first terminal being retained with said retaining portion; and a protective cover, for covering said housing and said second terminal mated to said first terminal, connected to said housing via a connecting member to pivotally move about said connecting member, wherein said protective cover has a wire support hole for limiting direction of a wire connected to said first terminal, said wire support hole is formed through a side wall of said protective cover.

15. The connector of claim 3, wherein said housing and said protective cover are integrally formed via said hinge portion.

* * * * *